US006021547A

United States Patent [19]

Stagoll

[11] Patent Number: 6,021,547

[45] Date of Patent: Feb. 8, 2000

[54] DOOR ADJUSTMENT MECHANISM

[75] Inventor: Dennis Stagoll, Keon Park, Australia

[73] Assignee: Anthony Bearings Pty Ltd., Keon Park, Australia

[21] Appl. No.: 09/073,934

[22] Filed: May 7, 1998

[30] Foreign Application Priority Data

May 20, 1997 [AU] Australia ..... PO6890

[51] Int. Cl.[7] ..... A47H 15/00

[52] U.S. Cl. ..... 16/105; 16/99; 49/425; 403/297; 411/55; 411/77

[58] Field of Search ..... 16/105, 99, 19, 16/32, DIG. 39, 238, 240, 245, 246, 247; 49/425; 403/297, 289, 290; 411/55, 77, 63, 64, 57

[56] References Cited

U.S. PATENT DOCUMENTS

| | | | |
|---|---|---|---|
| 2,668,318 | 2/1954 | Le Bon III . | |
| 2,717,413 | 9/1955 | Freschner | 16/105 |
| 3,060,624 | 10/1962 | Wenger . | |
| 3,443,340 | 5/1969 | Helmick et al. . | |
| 3,508,361 | 4/1970 | Ryder . | |
| 3,512,209 | 5/1970 | Povoden . | |
| 3,695,649 | 10/1972 | Laverone | 411/77 |
| 3,774,342 | 11/1973 | Thom . | |
| 3,996,643 | 12/1976 | Steigerwald | 16/99 |
| 4,064,593 | 12/1977 | Helmick . | |
| 4,189,870 | 2/1980 | Helmick . | |
| 4,194,266 | 3/1980 | Natzel | 16/99 |
| 4,262,451 | 4/1981 | Dallaire | 16/105 |
| 4,282,631 | 8/1981 | Uehara et al. . | |
| 4,873,741 | 10/1989 | Riegelman . | |
| 5,546,706 | 8/1996 | Coupet | 16/105 |
| 5,598,606 | 2/1997 | Jacobs | 16/105 |
| 5,671,502 | 9/1997 | Ezman . | |

FOREIGN PATENT DOCUMENTS

| | | |
|---|---|---|
| 75203 | 5/1976 | Australia . |
| 52132/86 | 7/1986 | Australia . |
| 2688261 | 9/1993 | France . |
| 237 870 | 7/1986 | Germany . |
| 295 21 051 | 10/1996 | Germany . |
| 9-53361 | 2/1997 | Japan . |
| 9-119258 | 5/1997 | Japan . |
| 9-125804 | 5/1997 | Japan . |
| 2142365 | 1/1985 | Ukraine . |
| WO 97/25507 | 7/1997 | WIPO . |

*Primary Examiner*—Chuck Y. Mah
*Attorney, Agent, or Firm*—Pollock, Vande Sande & Amernick

[57] ABSTRACT

An adjustment mechanism is disclosed for adjusting a support means such as wheels (5*a,* 5*b*) relative to a housing structure (2, 3) retaining said wheels (5*a,* 5*b*), the adjustment mechanism including a screw member (7) selectably movable in a direction (22) transverse to the intended adjusting movement direction (6) of said wheels (5*a,* 5*b*), the movement of said screw member (7) acting to move an adjustment member or members (9, 9*a,* 9*b*) in a direction perpendicular to said directions (6) and (22) with movement of said adjustment member or members causing movement of said wheels (5*a,* 5*b*) in said adjusting movement direction (6).

29 Claims, 4 Drawing Sheets

Fig 5
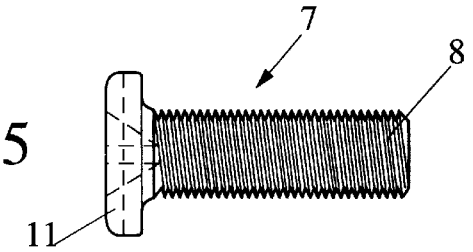
Fig 6a.
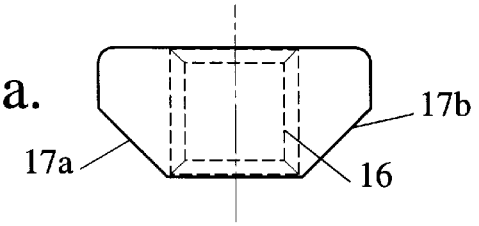
Fig 6c.
Fig 6b.
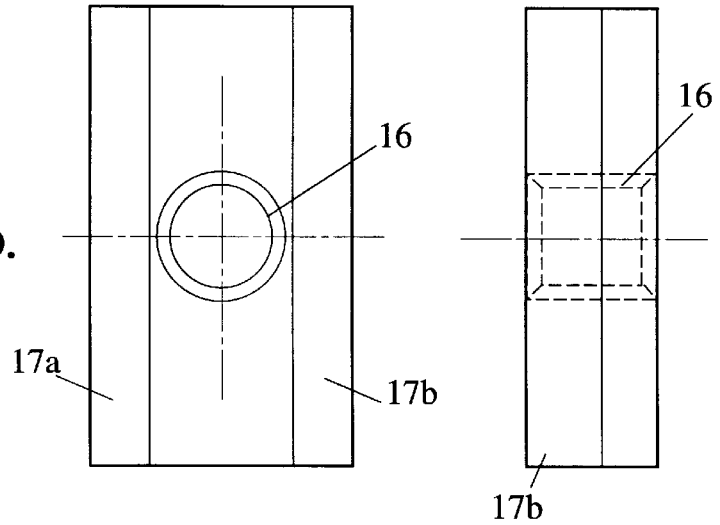
Fig 6d.
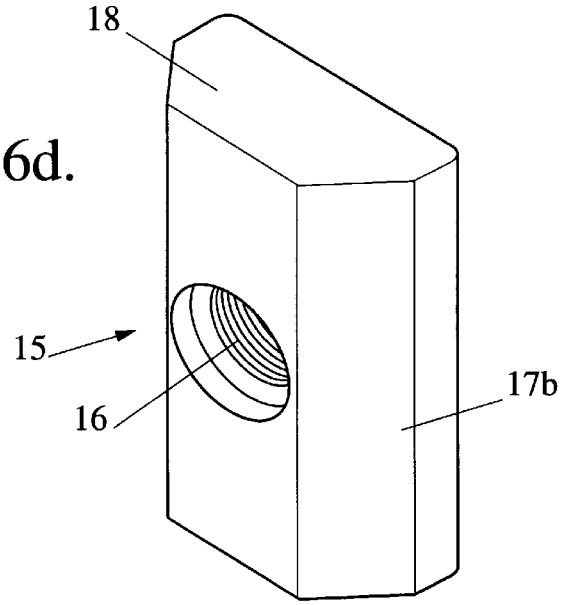

DOOR ADJUSTMENT MECHANISM

The present invention relates generally to improvements in adjustment mechanisms enabling positional adjustment of a first member relative to a second member. More particularly, the invention has been developed in association with positioning a door or other similar member relative to a surrounding support structure but the invention disclosed hereinafter will be seen to have applicability to many other situations.

For the sake of simplicity, the present invention will be described with reference to the installation of sliding doors such as glass, timber or metal sliding doors or the like but it should be recognized that the invention is not limited to this application. Typically sliding doors are mounted on or from wheel or roller members which are arranged to roll along a defined fixed guide track thereby enabling the door to slide during opening or closing of same. During installation of such arrangements, it will normally be necessary to vary the position of the wheel or roller members relative to the door thereby varying the door position relative to an associated support structure (or door frame) to achieve correct operation of the door.

Many mechanisms are known for achieving positional adjustment of such roller members relative to a door member or the like. For example the roller member might be fixed to a bracket member that is pivoted to the door structure with a threaded adjustment screw being provided to vary the pivoted position of the bracket member either by direct or indirect engagement therewith. Typical examples of this type of mechanism may be found in U.S. Pat. Nos. 4,189,870; 3,774,342; 3,060,524; 2,668,318 and 3,443,340. In other mechanisms the roller member may have pins slidably located in inclined slots in a carrier structure whereby translational adjustment of the carrier structure effected by a threaded screw member or similar will cause the pins to slide in the inclined slots thereby raising or lowering the roller members. Typical examples of such mechanisms may be found in U.S. Pat. No. 3,512,209 and UK Patent No. 2142365. In still further prior art mechanism types, the roller members might be mounted in a carrier structure with inter-engaging inclined ramp surfaces between the carrier structure and a surrounding housing connectable to the door, a threaded screw member being provided to enable positional adjustment of the carrier structure relative to the housing along the inclined ramp surfaces thereby adjusting the position of the roller members relative to the housing and the door. An example of a mechanism of this type may be found in Australian Patent Specification No. 484445.

There are potential difficulties with some aspects of either the installation or performance of the prior art adjustment mechanisms generally described above. Firstly, positional adjustment in door mounting applications and potentially in other applications, is normally required after initial installation where the adjustment mechanism is already under load. In many applications the loading can be considerable and the adjustment mechanism can only be safely adjusted by removing the loading before effecting the adjustment. This is inconvenient for installers often leading to the requirement being ignored and adjustment being attempted under loaded conditions by using more motive force (eg a power tool) than the adjustment mechanism can safely handle. Further, the location and position of the adjusting element (threaded screw) can also cause some difficulties with some prior art arrangements for the installer. There is further a need to ensure that the door, once adjusted, will maintain its desired position over time and with use. A number of known adjustment mechanisms suffer from backwinding, that is, the adjustment mechanism moves over time under the effects of use and loading caused by the door weight. Commonly this problem has previously been resolved by providing some form of separate locking arrangement which is used once the basic adjustment mechanism appropriately positions the door. While separate locking arrangements work satisfactorily, they do add to the complexity of the mechanism and therefore increase the costs of the mechanism. Finally some prior art positional adjustment mechanisms suffer from being limited in the amount of positional adjustment they can provide. It is of course desirable to provide as much adjustment as possible within the physical confines of the particular application involved.

Accordingly, it is an object of the present invention to provide an improved adjustment mechanism for positional adjustment of one member relative to another which will over come or alleviate one or more of the above discussed problems associated with certain prior arrangements.

According to one preferred objective of the present invention, a positional adjustment mechanism is provided that will improve the ease of adjustment under loaded conditions without significantly losing the extent of adjustment possible.

Accordingly, the present invention provides, in a first aspect, an adjustment mechanism for positionally adjusting a first member relative to a second member, said adjustment mechanism including a first adjusting means selectably movable in a first direction and retainable in a desired position once moved, said first adjusting means being arranged to act upon a second adjusting means movable, in response to movement of said first adjusting means in a second direction transverse to said first direction, and a third adjusting means engagable by said second adjusting means and being movable in response to movement of said second adjustment means in a third direction transverse to said second direction. Preferably the first, second and third directions are disposed at right angles to one another. Conveniently in one preferred arrangement the third direction is also arranged transverse to the first direction as well as the second direction.

Conveniently the first adjusting means includes a first engagement surface inclined to the first direction, the first engagement surface being preferably planar. Preferably the first adjusting means may also include a second engagement surface inclined to said first direction which may also be planar. The first adjusting means may comprise a body part or plate member on which the first and second engagement surfaces are formed in a mutually inclined wedge shaped configuration. Conveniently a threaded member such as a screw or the like is provided co-operable with the body part or plate member to move same in said first direction.

Conveniently the second adjusting means includes a third engagement surface engagable, in use, with said first adjusting means and being inclined to said first direction. Preferably the third engagement surface is planar. The second adjusting means may further include a fourth engagement surface which, in use, is engaged by the first adjusting means. Conveniently the third and fourth engagement surfaces may also be inclined relative to the first direction. In one preferred arrangement the first and third engagement surfaces are co-planar and the second and fourth engagement surfaces are co-planar.

Preferably the second adjusting means may be formed with a fifth engagement surface engagable, in use, by the third adjusting means and being inclined to said second direction. The fifth engagement surface may also be planar. The second adjusting means may also include a preferably planar sixth engagement surface engagable, in use, by said third adjusting means and being inclined to said second direction. Conveniently, said fifth and sixth engagement surfaces are also inclined relative to said third direction. In one preferred arrangement the third and the fourth engagement surfaces are movable relative to one another. Similarly, the fifth and sixth engagement surfaces may also be arranged movable relative to one another. In a particularly preferred arrangement the second adjusting means is formed by a first adjusting element carrying said third engagement surface and a second adjusting element carrying said fourth engagement surface, said first and second engagement elements being separably formed but co-operable in use whereby said third and fourth engagement surfaces cross over one another and conveniently also cross over the first direction. Preferably the threaded member or screw element arranged to move the first adjusting means in the first direction also, in use, passes through the first and second adjusting elements (in said first direction) whereby a maximum degree of contact between the first and third engagement surfaces (and conveniently the second and fourth engagement surfaces) is achieved while also maximising the possible length of movement of the first adjusting means in the first direction. This effectively enables the possibility of maximising the positional adjustment movements of the adjusting mechanism. Conveniently the fifth engagement surface is disposed at right angles to the third engagement surface. Similarly it is preferred the sixth engagement surface will be disposed at right angles to the fourth engagement surface.

In accordance with further preferred aspects, the third adjusting means includes a preferably planar seventh engagement surface engagable, in use, by said second adjusting means, said seventh engagement surface being inclined to said second direction. Conveniently the third adjustment means also includes a preferably planar eighth engagement surface engagable, in use, with the second adjusting means, said eighth engagement surface being inclined to said second direction. The seventh and eighth engagement surfaces may also be curved while maintaining the aforesaid inclined relationship. Conveniently also these engagement surfaces are inclined relative to the third direction. Preferably the seventh and eighth engagement surfaces are fixed relative to one another. Conveniently these two engagement surfaces converge towards one another in said third direction. Preferably the third adjusting means may either comprise a carriage member for one or more wheels or roller means or be co-operable with such a carriage member.

Conveniently the adjustment mechanism may further include a support structure having at least one portion with a threaded bore through which said threaded member passes, said support structure further including connection means enabling said support structure to be mounted to said first member. The present invention also anticipates providing a door assembly including an adjustment mechanism as described above wherein a door member forms the first member and at least one wheel or roller means forms the second member.

The structure of the adjusting mechanism as described above provides at least two separate inclined engagement surfaces each being co-operable with engagement parts which may also be inclined engagement surfaces. The motive force required to move, for example the second adjusting means in the second direction by movement of the first adjusting means in the first direction, is to a large extent dependent on the loading applied to the mechanism (for example the door weight) but this force can be relatively reduced by varying the angle of inclination of the cooperating engagement surfaces. However, varying the angle to reduce the required motive force also has the effect of reducing the extent of movement achieved in the second direction. Any loss of adjusting movement can, however, be recovered by the additional length of movement possible by the adjusting mechanism structure itself and including the provision of a second pair of inclined engagement surfaces. Thus it is possible, with appropriate disposition of angles of inclination, for the adjusting mechanism of the present invention to be adjusted under even relatively heavy external loading conditions without necessarily having to relieve those loading conditions. Moreover, it has been found that the adjusting mechanism of the present invention does not require any separate positional locking means once the adjustment mechanism has been adjusted in any particular application.

The invention will now be described with reference to preferred embodiments illustrated in the annexed drawings, in which:

FIG. 5 depicts an adjusting screw utilised in the adjustment mechanism.

FIGS. 6*a,* 6*b,* 6*c* and 6*d* depict the top, front, side and perspective views respectively of a first adjusting member utilised in the adjustment mechanism.

Figure 7A:
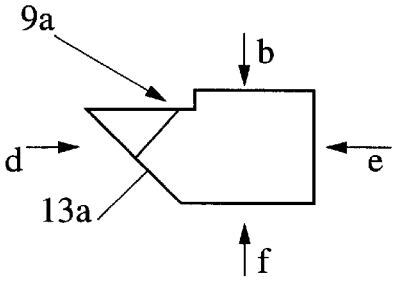
Figure 7B:
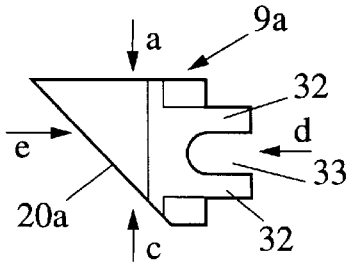
Figure 7C:
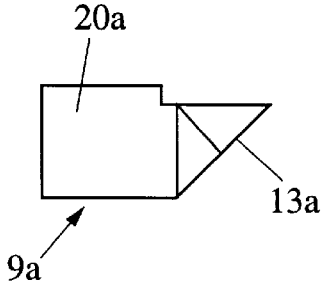
Figure 7D:
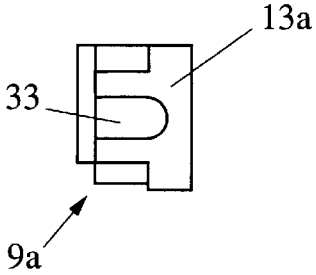
Figure 7E:
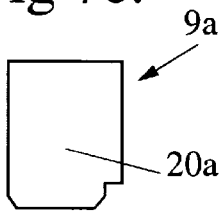
Figure 7F:
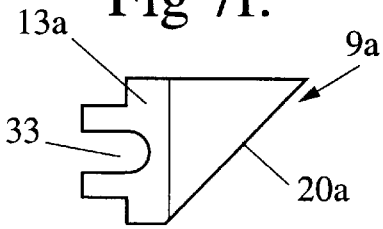

FIGS. 7*a,* 7*b,* 7*c,* 7*d,* 7*e* and 7*f* depict elevational views from various sides of a first adjusting element as part of the second adjusting means of the adjustment mechanism.

Figure 8A:
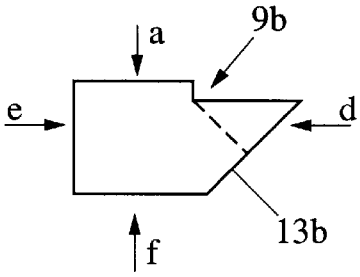
Figure 8B:
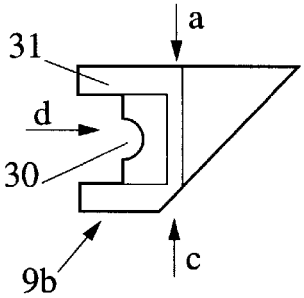
Figure 8C:
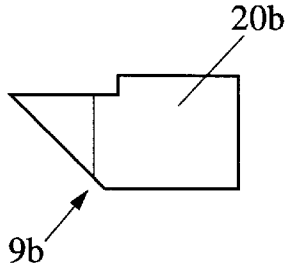
Figure 8D:
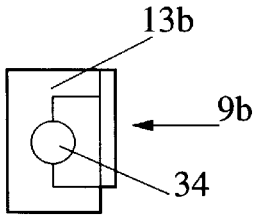
Figure 8E:
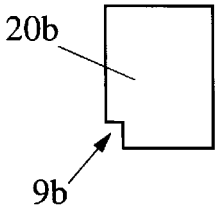
Figure 8F:
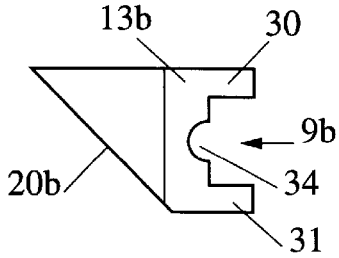

FIGS. 8*a,* 8*b,* 8*c,* 8*d,* 8*e* and 8*f* depict elevational views from various sides of a second adjusting element as part of the second adjusting means of the adjustment mechanism.

Figure 9:
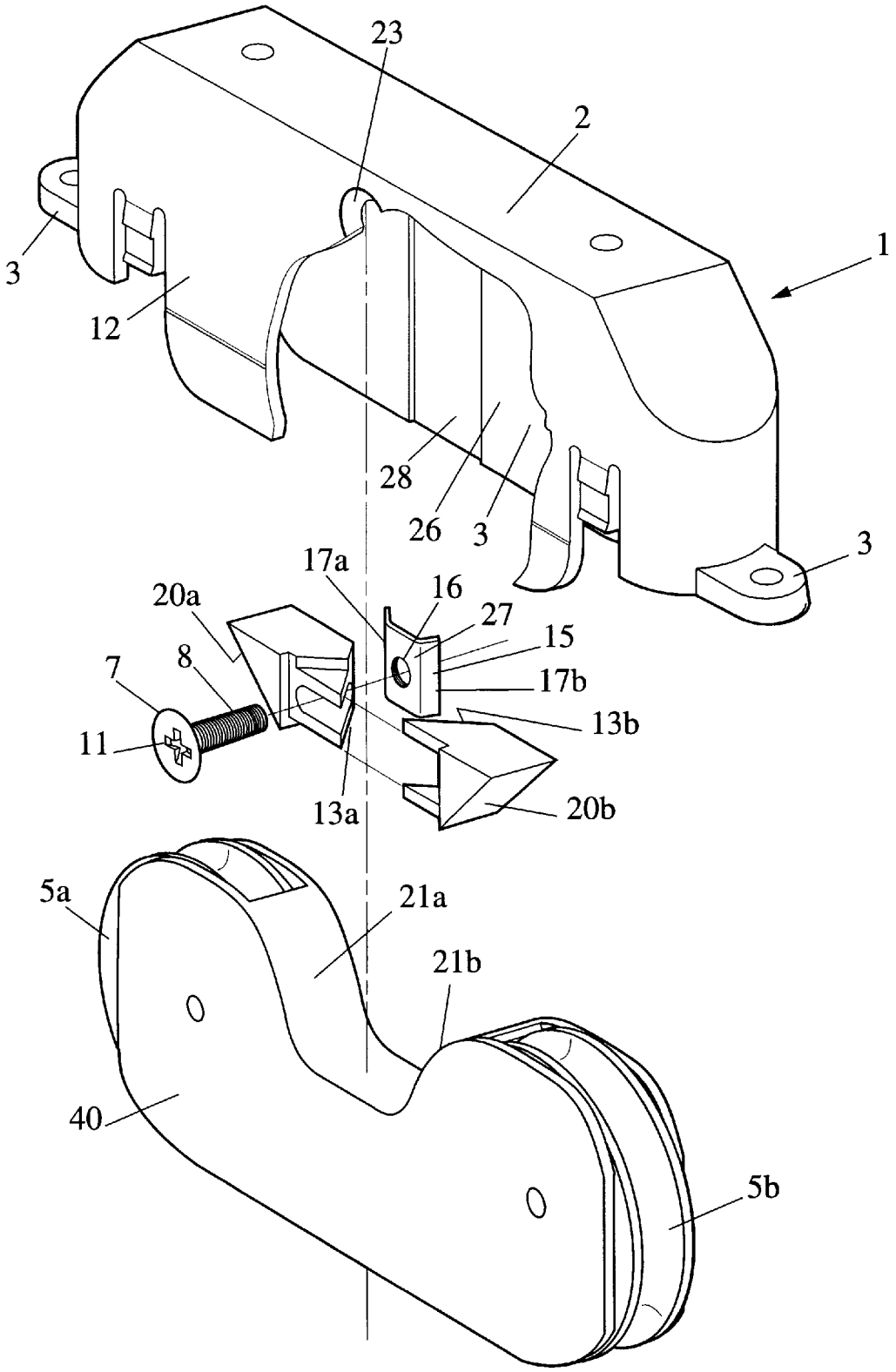

FIG. 9 is a perspective view, partially broken away, of a second embodiment of this invention.

Figure 1:
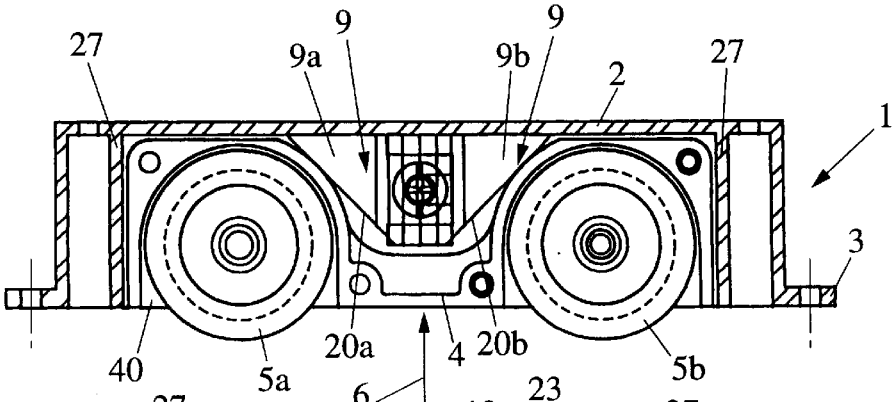
FIG. 1 is a partial cross-sectional side view of a wheel or roller assembly for a door assembly which includes a first preferred embodiment of an adjustment mechanism according to the present invention, the adjustment mechanism being depicted in a retracted position.

Referring to FIG. 1, a cross-sectional side view of a partially assembled wheel or roller assembly 1, for a sliding door is depicted including an adjustment mechanism according to the present invention. The bearing assembly 1 includes an outer housing 2 which is adapted for mounting to a door via mounting lugs 3 and includes transverse stiffening walls 27.

A wheel or roller carriage 4 is received within housing 2. Mounted on the carriage 4 are wheels 5*a,* 5*b* upon which the door is carried in use. Typically the wheels 5*a,* 5*b* are received within or on a track which guides the sliding motion of the door.

The carriage 4 is adapted to slide into and out of the outer housing 2 as indicated by arrows 6. The adjustment mechanism of the present invention provides for adjustment of the position of the carriage 4 in relation to the outer housing 2, and thus positional adjustment of the wheels 5*a,* 5*b* relative to the door. In FIG. 1 the carriage 4 is shown in a retracted position in relation to the outer housing 2.

Figure 2:
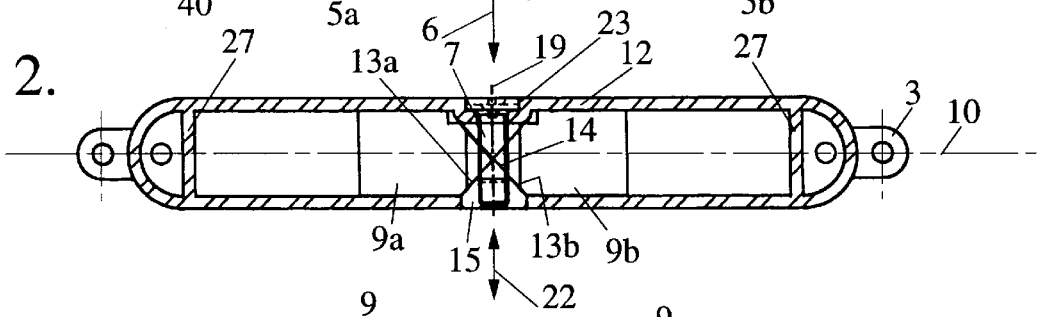
FIG. 2 is a partial cross-sectional plan view of FIG. 1.
Figure 3:
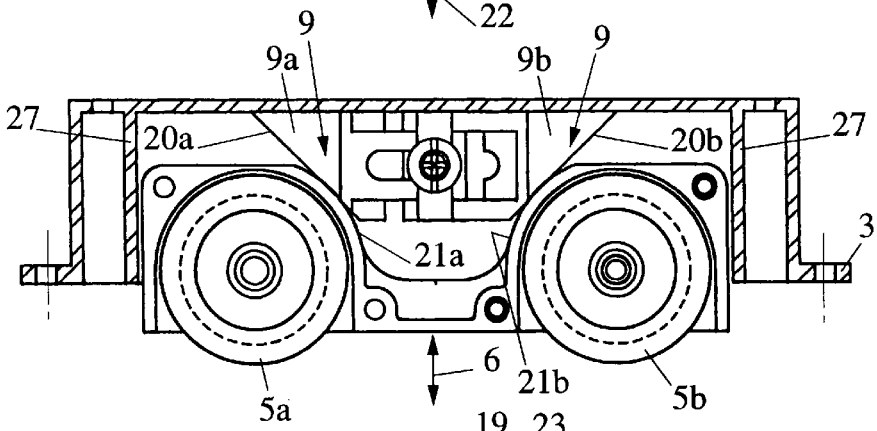
FIG. 3 is the same view as FIG. 1 with the adjustment mechanism depicted in an extended position.

Referring to the drawings, the adjustment mechanism includes a first adjusting means 15 in the form of a nut having a threaded bore 16 engagable with a threaded adjusting screw 7. The screw 7 extends in a first direction 22 transversely through the housing 2 with the head 11 of the screw 7 being received within a recess 23 in an outer side face 12 of the housing 2. The adjusting screw 7 passes through the adjusting mechanism to an aperture 25 in the opposed side wall 26 of the housing 2. The nut member 15 is rectangular in plan view (FIG. 6*b*) with its longer dimension generally spanning the distance between the opposed housing walls 12 and 26. The nut member further includes a first engagement surface 17*a* and a second engagement surface 17*b* which are preferably planar and inclined at a predetermined angle to the rotational axis 19 of the adjusting screw 7 or first direction 22. The arrangement is such as shown in FIGS. 2 and 3 that rotation of the screw 7 will move the nut member 15 from the position shown in FIG. 2 to that shown in FIG. 4.

The adjustment mechanism further includes a second adjustment means 9 which includes co-operable but separate first and second adjusting elements 9*a*, 9*b*, details of which are better seen in FIGS. 7*a* to 8*f*. The first and second adjusting elements are disposed within the housing 2 and are capable of translational movement in a second direction 10 coincident with the longitudinal plane of the housing 2. The extent of movement of the adjusting elements 9*a* and 9*b* can be seen from a comparison of FIGS. 1/2 and 3/4. Referring now to FIGS. 7*a* to 8*f*, the first adjusting element 9*a* includes a third engagement surface 13*a* which is preferably planar and angled to engage with the first engagement surface 17*a* of the nut member 15. The surface 17*a* is therefore inclined at an angle to both the first direction 22 and the second direction 10. Similarly the second adjusting element 9*b* includes a fourth engagement surface 13*b* which is preferably planar and angled to engage with the second engagement surface 17*b* of the nut member 15. The fourth engagement surface 13*b* has two spaced lateral arm portions 30, 31 which is adapted to receive the portion 32 of the first adjusting element 9*a* therethrough which effectively permits the surfaces 13*a* and 13*b* to cross over one another at the axis 19 as shown in FIG. 2. The adjusting elements 9*a* and 9*b* further include recessed portions 33 and 34 adapted to form an aperture 24 through which the adjusting screw 7 may pass even when the elements 9*a* and 9*b* are positioned most closely adjacent on another as shown in FIGS. 1 and 2. Finally, the first and second adjusting elements 9*a*, 9*b* each include fifth and sixth engagement surfaces 20*a* and 20*b* each of which are preferably planar and formed also at an inclined angle to the second direction 10. The surface 20*a* is inclined at an angle to the third direction 6. Similarly the surface 20*b* is at an inclined angle to both the second direction 10 and the third direction 6 with both surfaces 20*a* and 20*b* converging downwardly as shown in FIGS. 1 and 3.

Finally as shown on the drawings, a third adjustment means 4 is provided configured as a carriage for the wheels 5*a*, 5*b*. The carriage 4 includes a housing part 40 which is open at the bottom from which the wheels 5*a*, 5*b* partially project and which has an upper housing wall with a depression or recess between the wheels 5*a*, 5*b* which defines a seventh engagement surface 21*a* and an eighth engagement surface 21*b*. The surfaces 21*a*, 21*b* are curved but are generally inclined relative to the third direction 6. The surfaces 21*a* and 21*b* are fixed relative to one another by being integrally formed with the carriage 4 and generally converge in a downward direction. The surfaces 21*a*, 21*b* are also disposed so as to operatively engage with the surfaces 20*a* and 20*b* respectively of the adjusting elements 9*a* and 9*b*.

FIG. 9 illustrates a second embodiment shown in exploded perspective view where like features have been given the same reference numerals as in the earlier figures. The housing 2 in this case omits transverse stiffening walls 27 and includes an internal recess 28 rather than an aperture 25 in the wall 26. In this embodiment the nut member 15 is formed from a metal plate with the surfaces 17*a*, 17*b* being formed by inclined edge regions with the threaded bore 16 being formed in a central plate section 29.

Figure 4:
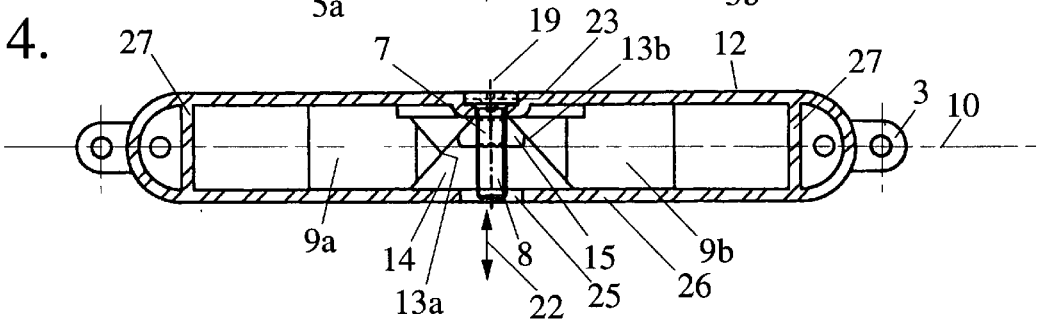
FIG. 4 is the same view as FIG. 2 with the adjustment mechanism depicted in an extended position.

Operation of the adjusting mechanism will now be described with reference to FIGS. 1 to 4 and 9. With the adjusting nut 15 in the position shown in FIGS. 1, 2, the wheels 5*a*, 5*b* are withdrawn into the housing 2 to a maximum extent in this position, the angled surfaces 17*a*, 17*b* of the nut member 15 are located within the V-shaped recess 14 defined by the surfaces 13*a*, 13*b* and further at one end of the surfaces 13*a* and 13*b*. Rotation of the adjusting screw 7 about the horizontal axis 19 will cause the nut member 15 to move from adjacent the wall 26 (FIG. 2) towards the opposed wall 12 of the housing 2. The extent of this movement is as shown in FIG. 4 where the nut member 15 has reached a position adjacent the wall 12 with the nut member having traversed substantially the length of the surfaces 13*a*, 13*b*. In so doing inter-engagement of the surfaces 17*a*/13*a* and 17*b*/13*b* has caused the adjusting elements 9*a*, 9*b* to move apart in the second direction 10. The configuration allows the maximum possible movement of the adjusting elements 9*a* and 9*b* by permitting the nut member 15 to traverse the full width of the housing 2 in operative engagement with the surfaces 13*a*, 13*b*. The motive force required to rotate the adjusting screw 7 can be reduced by reducing the angle of inclination of the surfaces 17*a*, 17*b* to the axis 19 but in doing so, the amount of movement of the elements 9*a* and 9*b* is also reduced. However, the increased level of movement permitted by the configuration of the mechanism relative to prior art devices counteracts this and permits effective and safe operation of the adjustment mechanism under most normal loading conditions. With the adjusting elements 9*a* and 9*b* moving outwardly or away from one another, the cooperating surfaces 20*a*/21*a* and 20*b*/21*b* cause the carriage 4 and therefore the wheels 5*a*, 5*b* to move downwardly to a maximum extent illustrated in FIG. 3. Reverse rotation of the adjusting screw 7 will result in reversing movement of the parts described above with the result that the carriage 4 moves back or upwardly into the housing 2 under loading applied to the mechanism.

The relative angles of the cooperating angled surfaces 17*a*/13*a*, 17*b*/13*b*, 20*a*/21*a* and 20*b*/21*b* can be varied as desired to allow the adjustment mechanism to be safely and conveniently operated under load conditions with the mechanism still being able to achieve desirable levels of positional adjustment. The motion of the adjustment mechanism gives use to an adjustment in the positioning of the wheels relative to the frame of the door. In this way, positional adjustment of the door can be achieved.

Advantageously the mechanical advantage provided by the mechanism enables the height of a door to be adjusted without the need to first relieve the weight of the door. It is further advantageous that this mechanism does not exhibit backwinding, that is the mechanism will maintain its adjusted position over time and under load.

A further advantage of the arrangement is that it provides a self centering effect insofar as the position of the carriage can move within the housing within limited tolerances to result in each bearing wheel 5*a*, 5*b* equally sharing the load of the door.

Thus it can be appreciated that the present invention provides an adjustment mechanism for doors mounted for sliding motion which improves the ease with which the position of the door can be adjusted.

I claim:

1. An adjustment mechanism for positionally adjusting a first member relative to a second member, said adjustment mechanism including a first adjusting means selectably movable in a first direction and retainable in a desired position once moved, said first adjusting means being arranged to act upon a second adjusting means movable, in response to movement of said first adjusting means, in a second direction transverse to said first direction, and a third adjusting means engagable by said second adjusting means and being movable in response to movement of said second adjustment means in a third direction transverse to said second direction.

2. An adjustment mechanism according to claim 1, wherein said first, second and third directions are disposed at right angles to one another.

3. An adjustment mechanism according to claim 2, wherein said third direction is also transverse to said first direction.

4. An adjustment mechanism according to claim 1, wherein the third adjusting means carries at least one wheel or roller means.

5. An adjustment mechanism according to claim 1, wherein said first adjustment means is selectively movable in said first direction by rotation of a threaded member engagable with said first adjustment means.

6. An adjustment mechanism according to claim 5, further including a support structure having at least one portion with a threaded bore through which said threaded member passes, said support structure further including connection means enabling said support structure to be mounted to said first member.

7. An adjustment mechanism according to any one of claims 1 to 4, wherein said first adjusting means includes a first engagement surface inclined to said first direction.

8. An adjustment mechanism according to claim 7, wherein said first engagement surface is planar.

9. An adjustment mechanism according to claim 7, wherein said first adjusting means includes a second engagement surface inclined to said first direction.

10. An adjustment mechanism according to claim 9, wherein said second engagement surface is planar.

11. An adjustment mechanism according to claim 9, wherein the first and the second engagement surfaces are fixed relative to one another.

12. An adjustment mechanism according to claim 7, wherein said second adjusting means includes a fifth engagement surface engagable, in use, by said third adjusting means and being inclined in said second direction.

13. An adjustment mechanism according to claim 12, wherein said fifth engagement surface is planar.

14. An adjustment mechanism according to claim 12, wherein said second adjusting means includes a sixth engagement surface engagable, in use, by said third adjusting means and being inclined to said second direction.

15. An adjustment mechanism according to claim 14, wherein said sixth engagement surface is planar.

16. An adjustment mechanism according to claim 7, wherein said third adjusting means includes a seventh engagement surface engagable, in use, by said second adjusting means, said seventh engagement surface being inclined to said second direction.

17. An adjustment mechanism according to claim 16, wherein the sixth engagement surface is planar.

18. An adjustment mechanism according to claim 16, wherein said third adjusting means includes an eighth engagement surface engagable, in use, by said second adjusting means, said eighth engagement surface being inclined to said second direction.

19. An adjustment mechanism according to claim 18, wherein said eighth engagement surface is planar.

20. An adjustment mechanism according to claim 18, wherein said seventh and said eighth engagement surfaces are fixed relative to one another.

21. A door assembly including at least one adjustment mechanism according to claim 20, wherein a door member forms the first member and the or each said wheel or roller forms the second member.

22. An adjustment mechanism according to any one of claims 1 to 4, wherein said second adjustment means includes a third engagement surface engagable, in use, by said first adjusting means and being inclined to said first direction.

23. An adjustment mechanism according to claim 22, wherein said third engagement surface is planar.

24. An adjustment mechanism according to claim 22, wherein said second adjusting means includes a fifth engagement surface engagable, in use, by said third adjusting means and being inclined to said second direction, said fifth engagement surface being disposed at right angles to said third engagement surface.

25. An adjustment mechanism according to claim 22, wherein said second adjusting means includes a fourth engagement surface engagable, in use, by said first adjusting means and being inclined to said first direction.

26. An adjustment mechanism according to claim 25, wherein the fourth engagement surface is planar.

27. An adjustment mechanism according to claim 25, wherein said second adjusting means includes a sixth engagement surface engagable, in use, by said third adjusting means and being inclined to said second direction, said sixth engagement surface being disposed at right angles to said fourth engagement surface.

28. An adjustment mechanism according to claim 25, wherein the third and the fourth engagement surfaces are movable relative to one another.

29. An adjustment mechanism according to claim 28, wherein said second adjusting means is formed by a first adjusting element carrying said third engagement surface and a second adjusting element carrying said fourth engagement surface, said first and said second adjusting elements being co-operable with one another whereby said third and said fourth engagement surfaces cross over one another.

* * * * *